US006808347B2

(12) United States Patent
Liersch

(10) Patent No.: US 6,808,347 B2
(45) Date of Patent: Oct. 26, 2004

(54) TENSIONING NUT TO SECURE A DISK-SHAPED TOOL

(75) Inventor: Ralph Liersch, Metzingen (DE)

(73) Assignee: Metabowerke GmbH, Nurtingen (DE)

( * ) Notice: Subject to any disclaimer, the term of this patent is extended or adjusted under 35 U.S.C. 154(b) by 0 days.

(21) Appl. No.: 10/339,828

(22) Filed: Jan. 10, 2003

(65) Prior Publication Data

US 2003/0152443 A1 Aug. 14, 2003

(30) Foreign Application Priority Data

Feb. 13, 2002 (DE) ..... 102 05 848

(51) Int. Cl.[7] ..... F16B 31/00; F16B 37/08

(52) U.S. Cl. ..... 411/6; 411/408; 411/428; 411/432

(58) Field of Search ..... 411/6, 7, 402, 411/408, 410, 428, 432

(56) References Cited

U.S. PATENT DOCUMENTS 5,388,942 A * 2/1995 Bonacina et al. ..... 411/432
5,577,870 A * 11/1996 Nakamura ..... 411/7
5,810,533 A * 9/1998 Nakamura ..... 411/7 X

FOREIGN PATENT DOCUMENTS

DE 19732263 1/1999

* cited by examiner

*Primary Examiner*—Neill Wilson
(74) *Attorney, Agent, or Firm*—Bourque & Associates

(57) ABSTRACT

A tensioning nut to secure a disk-shaped tool is threadable onto the threaded spindle of an electric tool, particularly an electric hand tool with run-out brake such as a right-angle grinder. The nut includes a nut body provided with a corresponding thread, with a coaxially-positioned pressure ring that may be tensioned with the disk-shaped tool. An axial bearing is positioned between the ring and the nut body. The nut further includes a disk member within the nut body for preventing rotation of the pressure ring. At least one engagement device is positioned between the disk member and the surrounding wall of the nut body. This blocking mechanism forms a uni-directional coupling, whereby a disengagement exists between the nut body in its tensioning direction and the disk member, and locking occurs between both of them in the opposing direction of the nut body relative to the disk member. Thus, loosening of the tensioning nut is prevented particularly during run-out of the rotating, disk-shaped tool.

9 Claims, 3 Drawing Sheets

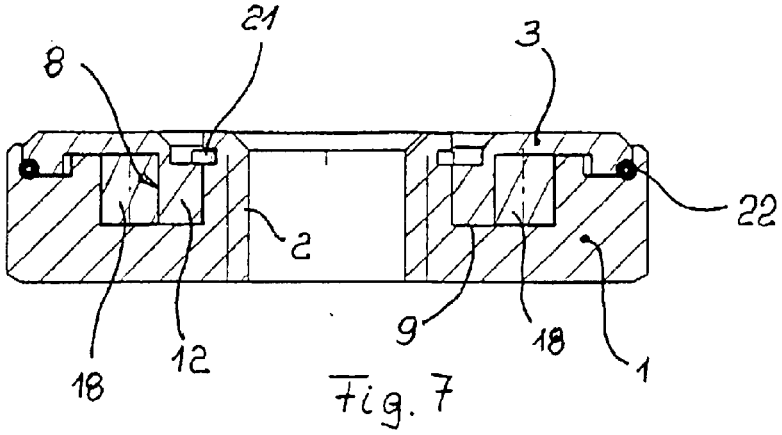
Fig. 7
Fig. 7
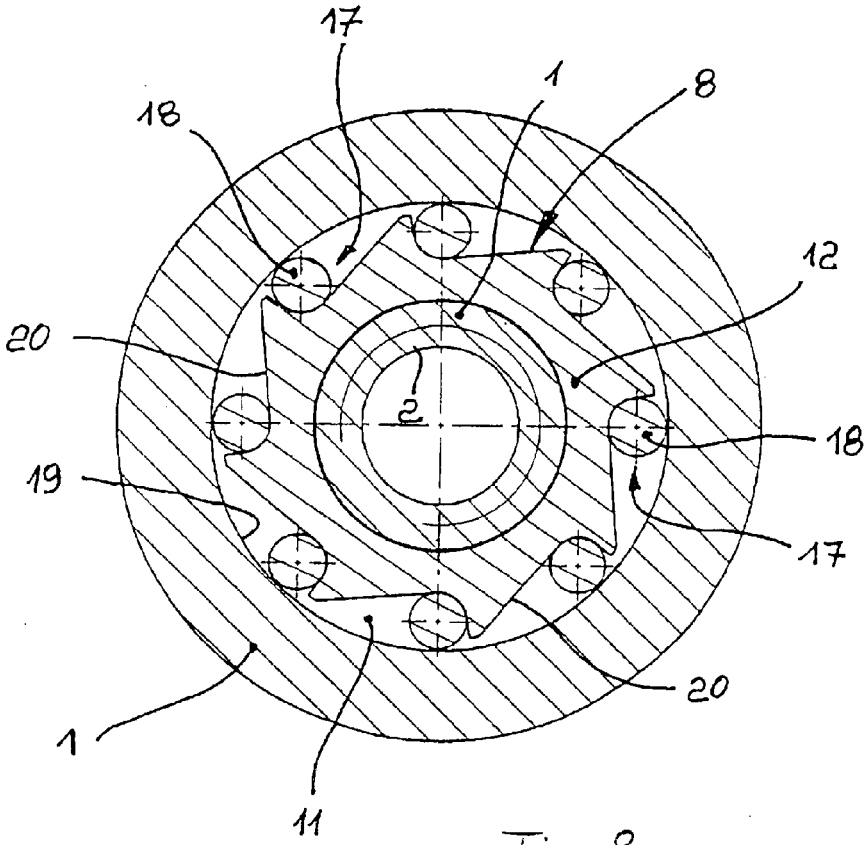
Fig. 8
Fig. 8

TENSIONING NUT TO SECURE A DISK-SHAPED TOOL

TECHNICAL FIELD

The invention relates to electrical tools, and more particularly to a tensioning nut to secure a disk-shaped tool on a threaded spindle of an electrical tool.

BACKGROUND INFORMATION

Electrical tools, particularly hand tools, have been equipped with a braking device so that the threaded spindle thereof quickly comes to a stop when the electrical drive is shut off. Such devices exist on circular saws and right-angle grinders to stop the saw blade or grinding disk quickly. Particularly with right-angle grinders and their rapidly-spinning grinding disks, there is the problem with rapid spindle braking of reducing the angular energy of the grinding disk, whereby the angular momentum of the grinder disk is directed in opposition to the tightening direction of the tensioning nut securing the grinder disk. Therefore, this tensioning nut must be one with which the grinder disk is secured to the threaded spindle of the electric hand tool.

Right-angle grinders with a run-out brake have been developed to reduce the hazard to the user. For this, the spinning grinder disk is braked to a stop very quickly after the device is switched off. Since the braking devices act on the tool spindle, there exists the danger that, in spite of a stopped tool spindle, the grinder disk continues to spin because of its angular energy, turning the tensioning nut connected with it against its tightening direction through friction. A conventional tensioning nut may thus loosen from the threaded spindle of the right-angle grinder, resulting in release of the rotating grinder disk from its mount on the threaded spindle.

Special tool tensioning devices have been developed for braked run-out right-angle grinders in order to be able to transfer the braking force on the threaded spindle to the grinder disk. Publication EP 0 459 697 A1 describes a tensioning nut that works together with a pressure flange attached to the threaded spindle of a right-angle grinder so that it may not rotate; the grinder disk is tensioned between the pressure flange and the tensioning nut. The tensioning nut may rotate only in the tightening direction relative to the pressure flange because of the so-called spinning block, and loosening the tensioning nut in the direction opposite to the rotation direction is only possible after the limitation of the block is manually released. For this, a part of the tensioning device must be displaced axially, which complicates its design and makes it vulnerable to failure.

Publication DE 43 37 023 A1 describes a tensioning nut for a braked run-out right-angle grinder that includes a pressure ring mounted in a nut body that is held within the nut body by a thread whose rotational direction is opposite to that of the thread between the nut body and the threaded spindle. When the grinder disk exerts torque on the pressure ring, it moves by rotation away from the grinder disk without transferring its rotational motion to the nut body, whereby release of the entire tensioning nut from the threaded spindle is prevented.

Publication DE 41 31 514 A1 describes a tensioning device that is also provided for a hand tool with spindle brake, particularly for a right-angle grinder. Here, either the outer tensioning nut or the inner pressure flange is provided with additional mechanical auxiliary supplement such as pressure members resting on spiral-shaped wedge-shaped surfaces by means of which the tensioning force is even increased during the braking of the devices threaded spindle. For this, a matching threaded spindle must be used, which is why the entire tensioning device is complex, and cannot be used on a grinder disk of conventional design.

Publication DE 41 22 320 A1 shows a tool-securing device for right-angle grinders with a braking device that is also complex because there is a coaxial shell displaceable along the threaded spindle that is provided at the machine end with an actuation lever, and the other end is connected with a pressure flange resting on the grinder.

Publication DE 195 09 147 C1 describes a tensioning nut to secure a disk-shaped tool for which an axial roller bearing is positioned between the nut body and the pressure ring along with a spring to transfer rotational motion. This design merely serves to function as a friction coupling when a limiting torque value is exceeded.

Publication EP 0 615 815 A1 describes a tool tensioning device on a right-angle grinder for which the tensioning nut rests against the threaded spindle by means of a blocking mechanism in the direction opposite its tightening direction in order to release the tensioning nut when the threaded spindle is driven in the opposite direction to the working direction.

SUMMARY OF THE INVENTION

One goal of the present invention is to create a tensioning nut to secure a disk-shaped tool to a threaded spindle of a run-out braked electrical hand tool that has a simple design, and further, which prevents unintentional loosening of the tool from the threaded spindle and which requires no design adaptation measures for the threaded spindle or the disk-shaped tool. The tensioning nut of the present invention thus may be used instead of a conventional tensioning nut.

The invention features a tensioning nut to secure a disk-shaped tool to a threaded spindle of an electrical tool with run-out brake. The nut includes a nut body that may be threaded onto the threaded spindle and removed from it, and a pressure ring positioned coaxially on the nut body and tensioning the tool. The nut also includes an axial bearing positioned between the pressure ring and the nut body, and a blocking disk which prevents rotation and rests in the nut body. The disk includes at least one blocking body positioned so that a disengagement exists between the nut body and the blocking disk in the tensioning direction, and engagement exists between the nut body and the blocking disk in the opposite direction, whereby the nut body and blocking disk rotate together.

A particular advantage of a tensioning nut of the present invention is that the nut body may be rotated in the tightening direction of the tensioning nut with respect to the pressure ring. The axial bearing serving as pressure bearing between the nut body and the pressure ring allows this relative rotation, while the blocking mechanism consisting of a blocking wheel and a blocking body represents a uni-directional coupling that allows rotation of the nut body relative to the pressure ring in only one direction, namely the tightening direction. Tightening the tensioning nut may be performed either manually or using a tool, and the pressure ring resting on the disk-shaped tool does not rotate with it. As a counter-bearing to tighten the tool, a conventional, inner pressure flange may be provided on the tool mount of the threaded spindle that rests on the threaded spindle in a fixed axial position with a friction fit and/or shape fit. In the working direction of the threaded spindle, which is opposite the tightening direction of the nut body, transfer of rotation between the pressure ring and the nut body results, with which two effects are connected. If the rotating tool is braked by the work process and thus torque is transferred from the pressure ring of the tensioning nut to the tool, then the relative limitation of the pressure ring is transferred to the nut body in the working direction, whereby the driven threaded spindle may rotate relative to the nut body in the tightening direction, tightening the tensioning nut further. On the other hand, the torque caused by the mass of the disk-shaped tool during run-out of a braked threaded spindle is merely transferred to the pressure ring of the tensioning nut and not to the nut body. If the tool resultantly rotates relative to the threaded spindle, which should not occur, then the rotation is not transferred to the nut body of the tensioning screw by the pressure ring rotating with the tool by friction. The tensioning force transferred from the pressure ring remains unchanged so that the friction present in the entire tool mount with respect to the tool is sufficient to bring the tool to a stop by means of the threaded spindle. Intentional loosening by the user of the tensioning nut by gripping the nut in a normal manner is independent of this.

Advantageous embodiment properties of the invention may be taken from the dependent claims. It is important to note that the present invention is not intended to be limited to a device or method which must satisfy one or more of any stated or implied objects or features of the invention. It is also important to note that the present invention is not limited to the preferred, exemplary, or primary embodiment (s) described herein. Modifications and substitutions by one of ordinary skill in the art are considered to be within the scope of the present invention, which is not to be limited except by the following claims.

BRIEF DESCRIPTION OF THE DRAWINGS

These and other features and advantages of the present invention will be better understood by reading the following detailed description, taken together with the drawings wherein:

FIG. 7 is a cross-sectional view along an axial level of another tensioning nut embodiment; and FIG. 8 is a radial cross-sectional view through the tensioning nut in FIG. 7.

DETAILED DESCRIPTION OF THE PREFERRED EMBODIMENTS

Figure 1:
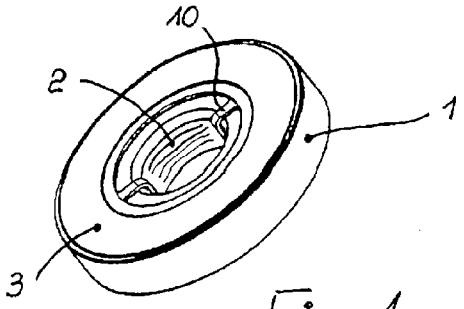
FIG. 1 is a perspective view of a tensioning nut used to secure a disk-shaped tool.
Figure 2:
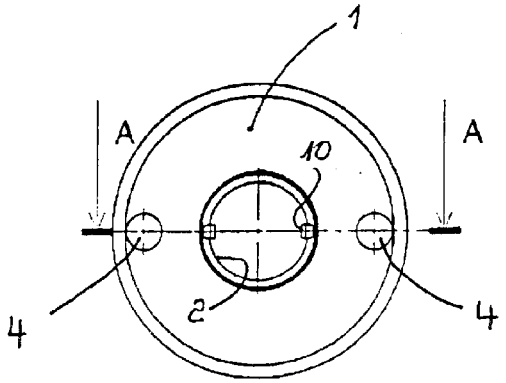
FIG. 2 is a front plan view of the tensioning nut in FIG. 1 seen from the actuation side.
Figure 3:
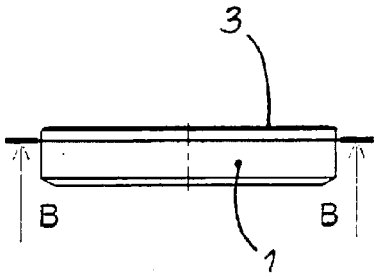
FIG. 3 is a top plan view of the tensioning nut as in FIGS. 1 and 2.

FIGS. 1 through 3 show the external properties of a tensioning nut that includes a nut body 1 as a bearing element that has a central opening with internal thread 2. The front face of the tensioning nut, visible in FIG. 1, is essentially formed by a pressure ring 3 that, as FIGS. 3 and 5 show, projects slightly out of the nut body 1. As will be explained below, this pressure ring 3 is rotatable with respect to the nut body 1, but only in one direction. FIG. 2 shows the actuation face of the tensioning nut to which the nut body 1 is connected. Two blind holes 4 are present on this face and are diametrically opposed to each other, to which a conventional actuation wrench with two matching, projecting carrier studs may be applied. The tensioning nut with the thread 2 of its nut body 1 may be threaded onto a threaded spindle 5 of an electric hand tool, such as a right-angle grinder, either using such a wrench or manually, FIG. 4 shows the overall mount for a matching grinder disk 6 on the threaded spindle 5 of a right-angle grinder.

Figure 4:
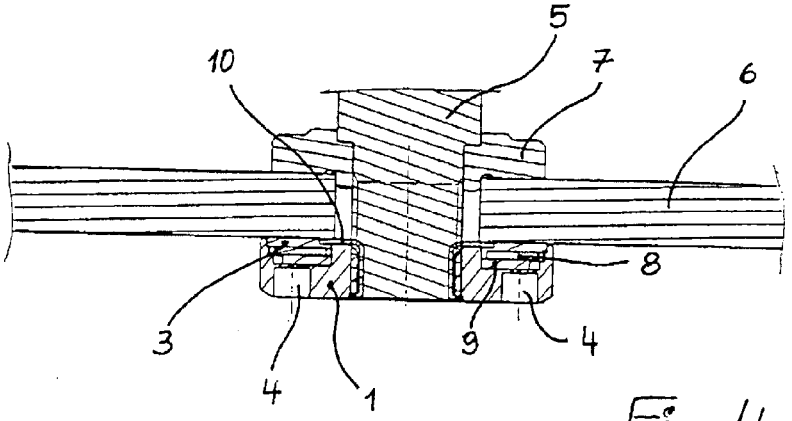
FIG. 4 is a sectional view through the tool mount of a right-angle grinder with a tensioning nut corresponding to the previous Figures along the line A—A in FIG. 2.
Figure 5:
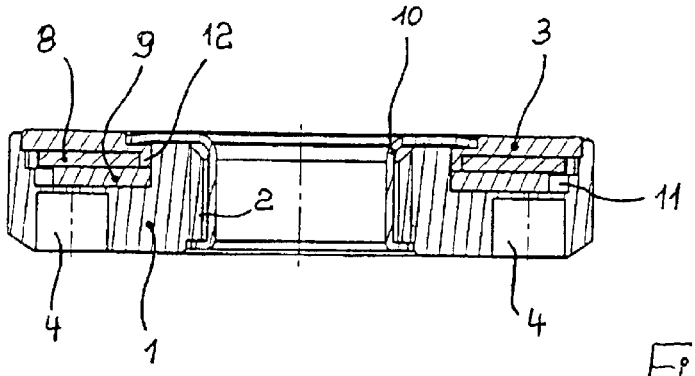
FIG. 5 is an enlarged cross-sectional view of the tensioning nut along the line A—A in FIG. 2.

As FIG. 4 further shows, the grinding disk 6 is tensioned against an inner pressure flange 7 using the thread 2 of the threaded nut body 1 onto the opposing thread of the threaded spindle 5. The pressure flange 7 rests against a shoulder of the threaded spindle 5, and in tensioned position of the overall device, the grinder disk 6 is connected with the threaded spindle 5 so that friction prevents its rotation. For this, the inner pressure flange 7 may be connected using form-fit with the threaded spindle 5 in the rotational direction.

In an enlarged view with respect to FIG. 4, FIG. 5 shows the individual components of the tensioning nut. The nut body 1 of the tensioning nut includes a ratchet groove or cavity 11 that opens toward the face of the nut body 1, which is positioned in the tensioned position with respect to the tool in question such as the grinder disk 6. The pressure ring 3 rests within the ratchet groove or cavity 11, which (as previously mentioned) projects slightly above the face of the nut body 1 along the axial direction. A disk member 8 is connected to the pressure ring 3 and faces inward thereof. The disk member 8 is described in more detail by FIG. 6. An axial bearing 9 is positioned on the bottom of the ratchet groove or cavity 11 by means of which the pressure ring 3 (and the disk member 8 as applicable) rests on the nut body 1 to the extent that the tensioning nut of the pressure ring 3 is loaded with pressure from without in the tensioned position under which it rests against the grinder disk 6. Thus, the axial bearing 9 acts as a pressure bearing, and it can be in the form of a friction bearing or roller bearing, depending on requirements and space. The pressure ring 3 includes a hub part 12 formed on its inner circumference and projecting axially over the axial bearing 9 on the nut body 1. The pressure ring 3 may also be supported by the disk member 8 on the nut body 1. The pressure ring 3 can basically be one functional or structural unit with the disk member 8 and/or the axial bearing 9. The important thing is that the pressure ring 3 may rotate with respect to the nut body 1, whereby the disk member 8 ensures that this rotation may only be in one direction, namely in the so-called working direction of the grinder disk 6 or the threaded spindle 5. This working direction is in opposition to the tensioning rotational direction of the tensioning nut to which the thread 2 in the nut body 1 and the corresponding opposing thread of the threaded spindle 5 matches. Thus, relative rotational motion is provided between the threaded spindle 5 and the nut body 1 of the tensioning nut in that tightening the tensioning nut results in disengagement between the nut body 1 and the pressure ring 3.

The pressure ring 3, the disk member 8, and the axial bearing 9 are held tightly in the ratchet groove or cavity 11 of the nut body 1 by a so-called mounting cage 10 that preferably lies in axial slots of the central threaded hole of the nut body 1 with matching axial ribs, thus contributing to additional limitation between the tensioning nut and the threaded spindle 5. The cage 10 overlaps a recess on the pressure ring 3 with ribs diametrically opposed to one another, as seen in FIGS. 1 and 5, to simultaneously secure the disk member 8 and the axial bearing 9 within the ratchet groove or cavity 11 of the nut body 1.

Figure 6:
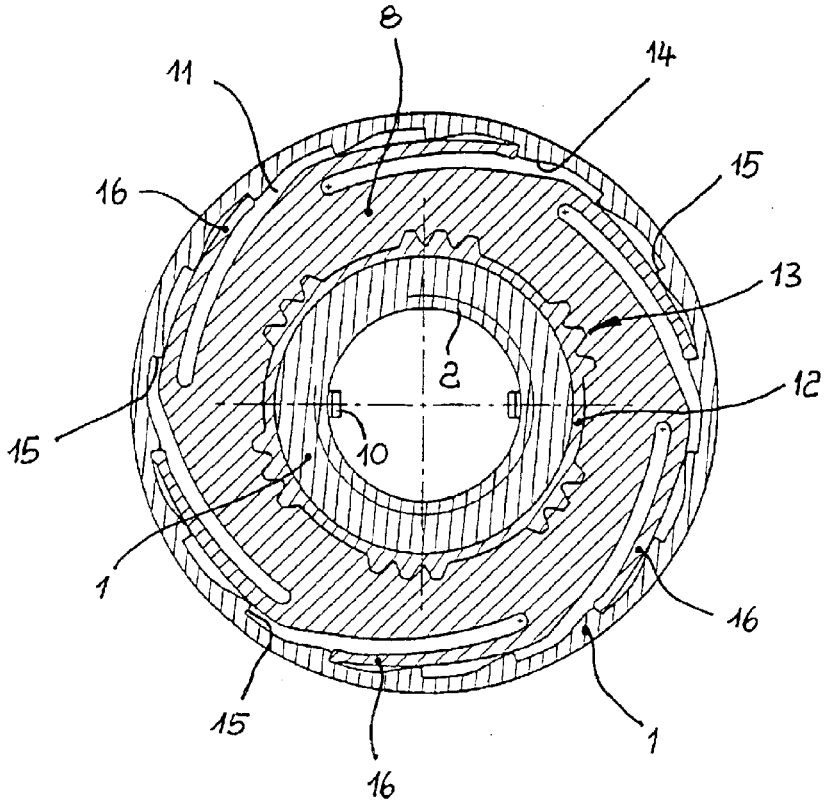
FIG. 6 is a radial cross-sectional view through the tensioning nut along the line B—B in FIG. 3.

FIG. 6 shows the function of the disk member 8 which, as FIG. 5 shows, is in the form of a relatively thin disk. Thus, the disk member 8 may be manufactured inexpensively as a pressed sheet-metal part. The disk member 8 is a part of a so-called moving block that may also be called a unidirectional coupling. The disk member 8 is provided so that the pressure ring 3 may rotate in only one direction with respect to the nut body 1 or vice versa, and the disk member 8 is firmly connected for that reason to the pressure ring 3 so that it may not rotate. The disk member 8 sits correspondingly on the axially projecting hub part 12 of the pressure ring 3, and a toothed area 13 of the hub part 12 provides a form-fit connection between the disk member 8 and the hub part 12 of the pressure ring 3. Ratcheting or resilient pawls 16 are positioned on the periphery of the disk member 8 in the format of elastically linkable blocking catches. These ratcheting or resilient pawls 16 are one-piece spring tongues unitarily formed with the disk member 8. The bodies 16 are positioned as to project in a tangential direction around the exterior circumference of the disk member 8. The ratcheting or resilient pawls 16 rest against the outside wall 14 of the ratchet groove or cavity 11 in the nut body 1, along which a number of engagement recesses 15 are formed, on one flank of it lying essentially in the radial direction, against which the ratcheting or resilient pawl 16 rest to the extent that the disk member 8 rotates clockwise with respect to the nut body 1 as seen in FIG. 6. In the opposing rotational direction of the disk member 8, the ratcheting or resilient pawls 16 ratchet over the engagement recess 15 which allows the disk member 8 to rotate without bringing the nut body 1 with it. Since the disk member 8 cannot rotate with respect to the pressure ring 3, this also applies to the pressure ring 3.

Such a freewheel unidirectional coupling may also be implemented between the pressure ring 3 and the nut body 1, as FIGS. 7 and 8 show. Here, the hub part 12 of the pressure ring 3 forms the disk member 8 with its radial outer area. Receiver recesses 17 are formed in the circumferential direction of the hub part 12 of the pressure ring 3 in which clamping bodies/protrusions 20 are positioned that rest radially outward against the opposite wall 19 of the ratchet groove or cavity 11 in the nut body 1. In this case, the wall 19 of the ratchet groove or cavity 11 is formed as a hollow cylinder. The receiver recesses 17 engage in the direction that opposes the tensioning rotational direction of the nut body 1, and include for this matching clamping or ramping bodies/protrusions 20 that extend to the inner wall 19 limiting the ratchet groove or cavity 11 in the nut body 1, by means of which the receiver recesses 17 taper down to this inner wall 19 in the desired direction. When the nut body 1 is rotated against the tensioning direction relative to the pressure ring 3, the clamping bodies/protrusions 20 acting as blocking bodies engage accordingly between the wall 19 and a particular clamping ramp 20, so that the pressure ring 3 is thus carried along over the hub part 12 by the rotation of the nut body 1. In the opposite case, where the pressure ring 3 rotates in the working direction or the grinder disk 6 relative to the nut body 1, the nut body 1 is not rotated with it in that disengagement occurs between the pressure ring 3 and the nut body 1 during this relative movement. The function here is basically the same as for the embodiment example in FIGS. 5 and 6.

As FIG. 7 clearly shows, only the so-called disk member 8 need be integrated into the hub part 12 of the pressure ring 3, and also the face surface of the hub part 12 resting on the floor or base of the ratchet groove or cavity 11 in the nut body 1 may be a member of the friction bearing forming the axial bearing 9 whose second member is formed by the ring surface on the floor of the ratchet groove or cavity 11 that is contacted by the front face of the hub part 12 of the pressure ring 3.

As FIG. 7 further shows, securing of the pressure ring 3 in the ratchet groove or cavity 11 of the nut body 1 may be provided by a snap ring 21 that engages in matching circumferential slots on the inner circumference of the pressure ring 3 and on the opposing wall of the ratchet groove or cavity 11 of the nut body 1. Further, FIG. 7 shows that a sealing ring 22 is provided particularly along the outer circumference of the pressure ring 3 in order to protect the blocking mechanism in the interior of the ratchet groove or cavity 11 of the nut body 1 from contamination.

The tensioning nut can be used for many types of electrical hand tools, such as, for example, a grinder disk, without having to make alterations to the device. Operation is the same as with conventional tensioning nuts so that the tensioning nut may be threaded on by hand, and the supporting pressure ring 3 on the tool 6 is not carried along in the tightening direction of the nut body 1 so that blocking during threading of the tensioning nut is no longer required. The tensioning nut is further tightened by the braking moment of the tool 6 relative to the driving threaded spindle 5 when engaging the worked material. The rotational transfer between the pressure ring 3 and the nut body 1 in the working rotational direction of the threaded spindle 5 ensures this. This effect also arises when the electrical hand tool is switched on because of the inertia of the disk-shaped tool 6 to be accelerated. During run-out, the friction present in the tool mount, due to the tensioning force of the tensioning nut, is sufficient to stop the tool 6 in a short time, without slippage relative to the threaded spindle 5. If, however, for whatever reason, relative rotation occurs between the tool 6 and the threaded spindle 5 because of the inertia of the tool 6, then the tensioning screw is not carried along because of the disengagement between the pressure ring 3 of the nut body 1 connection by friction with the tool 6, so that the tensioning force remains active, the tensioning nut does not loosen, and in the worst case, the tool 6 cannot fall off the threaded spindle 5.

As mentioned above, the present invention is not intended to a device or method which must satisfy one or more of any stated or implied objects or features of the invention and should not be limited to the preferred, exemplary, or primary embodiment(s) described herein. Modifications and substitution by one of ordinary skill in the art are considered to be within the scope of the present invention which is not to be limited except by the claims which follow.

What is claimed is:

1. A tensioning nut to secure a disk-shaped tool to a threaded spindle of an electrical tool with a run-out brake, the nut comprising:

a nut body adapted to be removably connected with the threaded spindle;

a pressure ring positioned coaxially on the nut body and tensioning the tool;

an axial bearing positioned between the pressure ring and the nut body;

a disk member operatively disposed with said pressure ring; and at least one engagement device, wherein said at least one engagement device is positioned so that a disengagement exists between the nut body and the disk member in the tensioning direction, and engagement exists between the nut body and the disk member in the opposite direction, whereby the nut body and disk member rotate together.

2. The tensioning nut as in claim 1, wherein the nut body includes a cavity having an opening facing the tool to be tensioned, wherein the pressure ring, the disk member, and the axial bearing are positioned within said cavity and are secured to the nut body by means of a securing element.

3. The tensioning nut as in claim 2, wherein the pressure ring includes an axially-projecting hub part, wherein the disk member is positioned between the hub part and an inner wall of the nut body and the axial bearing is positioned between said disk member and a base of the cavity.

4. The tensioning nut as in claim 2, wherein the disk member includes a plurality of teeth sized and shaped to engage a plurality of teeth of the hub part of the pressure ring.

5. The tensioning nut as in one of claim 1 wherein the engagement device disk member includes at least one radially-disposed blocking pawl disposed on an outer circumference of said disk member, wherein said radially-disposed blocking pawl engages with at least one engagement recesses disposed about an outer wall of the cavity of the nut body during rotation of the nut body in the direction opposite the tensioning direction.

6. The tensioning nut as in claim 5, wherein said engagement device includes a plurality of radially-disposed blocking pawls disposed along the outer circumference of the disk member formed as one-piece spring tongues with the disk member.

7. The tensioning nut as in claim 1 wherein the disk member includes at least one receiver recess along its outer circumference, wherein rolling blocking body is positioned within said receiver recess, whereby the receiver recess includes a ramped sections inclined relative to an inner wall of the nut body.

8. The tensioning nut as in claim 3 wherein the pressure ring and the disk member are of a single, unitary.

9. The tensioning nut as in claim 3 wherein a lower surface of the hub part rests on the base of the cavity of the nut body and a contact surfaces of the hub part and the cavity form the axial bearing as sliding elements.

* * * * *